US011554312B2

(12) United States Patent
Chioclea

(10) Patent No.: US 11,554,312 B2
(45) Date of Patent: Jan. 17, 2023

(54) MOTORIZED DRIVE UNIT FOR IN-LINE SKATES

(71) Applicant: Yoav Zvi Chioclea, Tel-Aviv (IL)

(72) Inventor: Yoav Zvi Chioclea, Tel-Aviv (IL)

( * ) Notice: Subject to any disclaimer, the term of this patent is extended or adjusted under 35 U.S.C. 154(b) by 0 days.

(21) Appl. No.: 17/412,710

(22) Filed: Aug. 26, 2021

(65) Prior Publication Data

US 2022/0062742 A1 Mar. 3, 2022

Related U.S. Application Data

(60) Provisional application No. 63/072,127, filed on Aug. 29, 2020.

(51) Int. Cl.
*A63C 17/12* (2006.01)
*A63C 17/06* (2006.01)

(52) U.S. Cl.
CPC ..... *A63C 17/12* (2013.01); *A63C 17/06* (2013.01); *A63C 2203/12* (2013.01)

(58) Field of Classification Search
CPC ..... A63C 17/12; A63C 17/06; A63C 2203/12
See application file for complete search history.

(56) References Cited

U.S. PATENT DOCUMENTS

| | | | | | |
|---|---|---|---|---|---|
| 1,694,671 | A * | 12/1928 | Rodelli | F16D 53/00 | 188/74 |
| 5,236,058 | A * | 8/1993 | Yamet | A63C 17/12 | 280/11.208 |
| 5,413,380 | A * | 5/1995 | Fernandez | A63C 17/10 | 280/844 |
| 5,797,466 | A * | 8/1998 | Gendle | A63C 17/265 | 180/181 |
| 2012/0228045 | A1* | 9/2012 | Kim | A63C 17/12 | 180/206.8 |
| 2012/0325567 | A1* | 12/2012 | Ganeous | A63C 17/10 | 180/9.23 |
| 2016/0067588 | A1* | 3/2016 | Tan | B60L 15/00 | 180/181 |
| 2019/0168105 | A1* | 6/2019 | Hilt | F16H 7/06 | |
| 2020/0197786 | A1* | 6/2020 | Artemev | A63C 17/08 | |
| 2021/0322859 | A1* | 10/2021 | Zhang | A63C 17/12 | |

* cited by examiner

*Primary Examiner* — Brian L Swenson

(57) ABSTRACT

According to an aspect of some embodiments of the present invention there is provided a driving unit for an in-line skate system having roller wheels, the driving unit has a motor configured to generate a driving power, a transmission gear coupled to the motor, and a transmission belt interconnecting the transmission gear and the two or more roller wheels to transfer the driving power to the roller wheel. According to an aspect of some embodiments of the present invention there is provided an in-line skate system, comprising one or more in-line skates and a driving unit.

20 Claims, 3 Drawing Sheets

MOTORIZED DRIVE UNIT FOR IN-LINE SKATES

FIELD AND BACKGROUND

The present invention, in some embodiments thereof, relates to wheeled skates and, more particularly, but not exclusively, to motorized in-line skates.

Driving of in-line skates is typically by movements of the body and legs of a person who wears the skates. This requires acquiring some skills to make the driving efficient and safe. In some cases, one who wears the skates could benefit of having the skate motorized and driven by energy supplied by the motor.

International Patent Application Publication No. KR 2005/0006027 discloses in-line skate driven by an electric motor includes a driving portion coupled to a lower portion of a shoe. A small bevel gear of an axis of the electric motor engaged with a large bevel gear of a bearing and shaft to conduct a first deceleration action. The large bevel gear and a small spur gear of same shaft are engaged with a large spur gear of another bearing and shaft to conduct a second deceleration action. The large spur gear and a driving pulley on same rotating shaft are frictionally braked by a position change of a shaft engaging pin so as to allow the electric motor to be freely driven. The wires of the entire system are connected to each other through a rechargeable cell belt and a rechargeable cell jack, so as to identify on/off states of a main power via the rechargeable cell belt and integral controller, to control driving speed and to indicate remaining level of the rechargeable cell.

U.S. Pat. No. 7,204,330 discloses battery-powered, remote-controlled, motor-driven, steerable roller skates. Each skate includes a boot, a transmitter, a base, a driving mechanism, a steering mechanism, a controller, and a receiver. The boot is worn on a foot of a user. The transmitter is battery-powered, is held by the user, and transmits wireless signals for controlling speed, steering, forward and reverse motion, and combinations thereof. The base has the boot sitting thereon. The driving mechanism is battery-powered, motor-driven, and operatively connected to, and selectively moves, the base with the boot thereon. The steering mechanism is battery-powered, motor-driven, and operatively connected to, and selectively steers, the base with the boot thereon. The controller is battery powered, disposed in the base, and operatively connected to, and selectively activates, the driving mechanism and the steering mechanism. The receiver is battery-powered, disposed in the base, and operatively connected to, and selectively activates, the controller by receipt of the wireless signals from the transmitter so as to allow the base with the boot thereon to move and steer by remote-control.

SUMMARY

According to an aspect of some embodiments of the present invention there is provided a driving unit for an in-line skate system having roller wheels, the driving unit comprises a motor configured to generate a driving power, a transmission gear coupled to the motor, and a transmission belt interconnecting the transmission gear and the two or more roller wheels to transfer the driving power to the roller wheel. In some embodiments, of the invention, the transmission belt is connected to two or more roller wheel. In some embodiments, of the invention, the transmission gear is coupled to an output shaft of the motor. According to some embodiments, the driving unit comprises a one or more transmission wheels, coupled to the roller wheel and the transmission belt is fitted to the one or more transmission wheels. In some embodiments, the transmission belt is coupled to a side portion of the roller wheels. In some embodiments, the driving surface of the roller wheels is free to contact a driving surface when driving unit is attached to the in-line skates.

According to some embodiments, the driving unit comprises one or more gear wheels, transmitting rotation power between the motor and two or more wheel of the in-line skate system.

According to some embodiments of the present invention, the driving unit comprises a regeneration unit, which recharges a battery in a regeneration mode initiated when the roller wheels rotate in a speed higher than the wheel rotation speed provided by the driving unit. In some embodiments, the regeneration unit comprised the motor and the transmission gear, and the transmission gear is adapted to transfer an external torque applied on the roller wheel to the motor. According to some embodiments, the regeneration unit comprises a gearing mechanism adapted to reverse the rotation of the motor when in the regeneration mode. In some embodiments, the regeneration unit comprising a regeneration clutch for switching between torque driving mode, the regeneration mode for transferring torque from the roller wheels to the motor According to some embodiments, the driving unit comprises a clutch mechanism that allows to reduce the rotation of the roller wheels when the motor is operating.

According to an aspect of some embodiments of the present invention there is provided an in-line skate system, comprising one or more in-line skates and a driving unit as described elsewhere herein.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF SPECIFIC EMBODIMENTS OF THE INVENTION

Figure 1A:
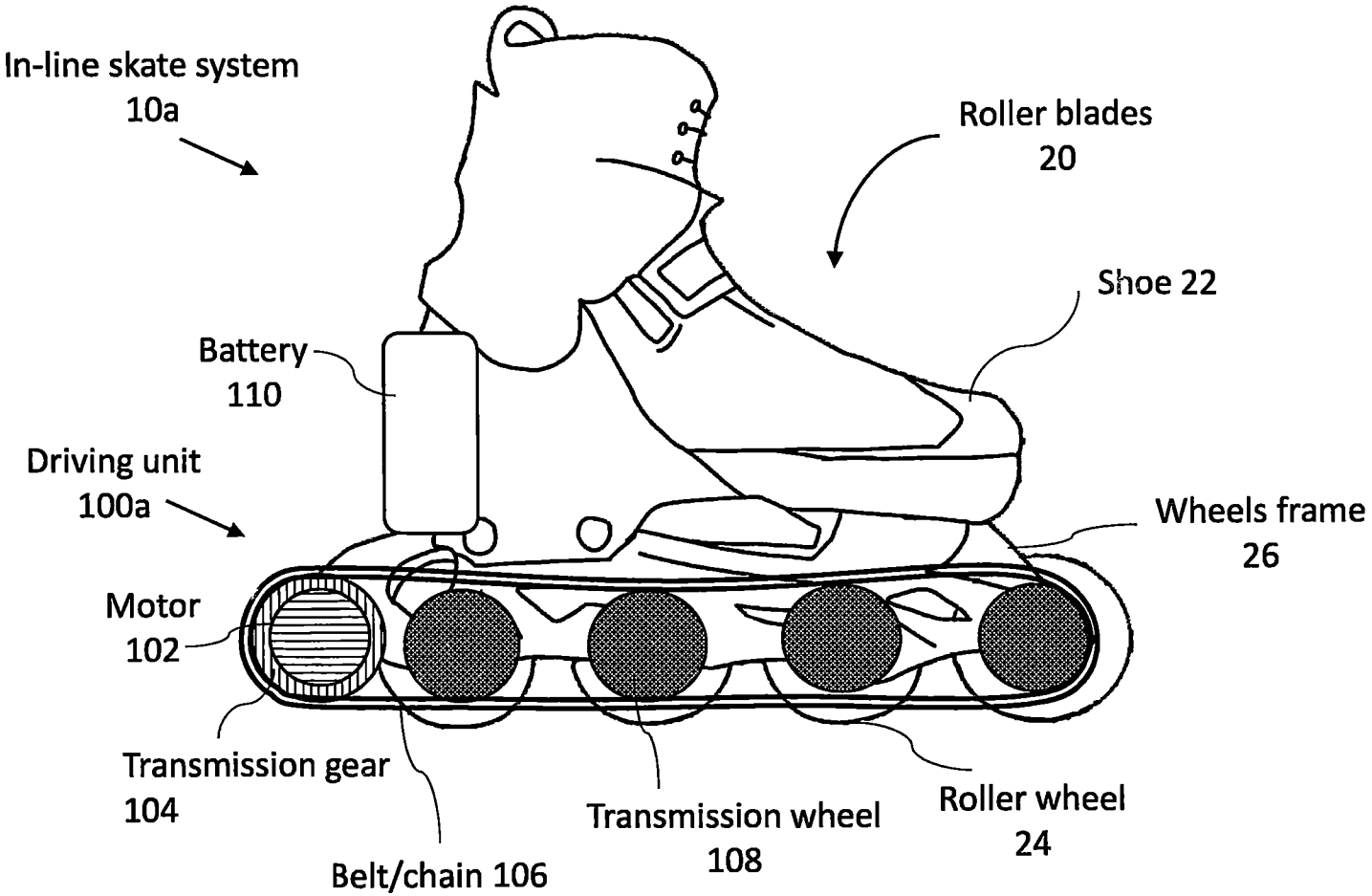
FIGS. 1A to 1C are schematic side view illustrations of in-line skate systems according to some embodiments of the current invention.

The present invention, in some embodiments thereof, relates to wheeled skates and, more particularly, but not exclusively, to motorized in-line skates.

Overview

According to an aspect of the current invention there is provided a driving unit for in-line skate system (e.g. roller blades). The driving unit includes a driving actuator, which receives driving power (e.g. torque) from a motor. According to some embodiments, the driving actuator transfers rotation power to two or more roller wheels of the in-line skate system. In some embodiments, driving unit includes a transmission gear receiving rotation power from the motor. In some embodiments, the driving unit includes a driving belt (e.g. transmission belt or transmission chain) connected to two or more roller wheel. In some embodiments, driving unit includes one or more of transmission wheels, coupled to roller wheel and the transmission belt is fitted to the transmission wheel for transferring torque between the motor and the transmission wheel. In some embodiments, the driving belt is coupled to the transmission wheel (directly or indirectly using transmission means). In some embodiments, the driving actuator includes one or more gear wheels, transmitting rotation power between the motor and two or more wheel of the in-line skate system. In some embodiments, the transmission wheel is one of the one or more gear wheels.

According to an aspect of the current invention there is provided an in-line skate system, having an in-line skate with two or more roller wheels. The in-line skate system has at least two wheels connected to a driving unit as described elsewhere herein.

Transmitting rotational power directly to multiple wheels of the in-line skate may have at least the following potential advantages: distributing rotational transmission load provided by the motor between a plurality of the in-line skates. This may require simpler and reduced mechanical constraints of each of the wheels that drive the in-line skate.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Figure 1B:
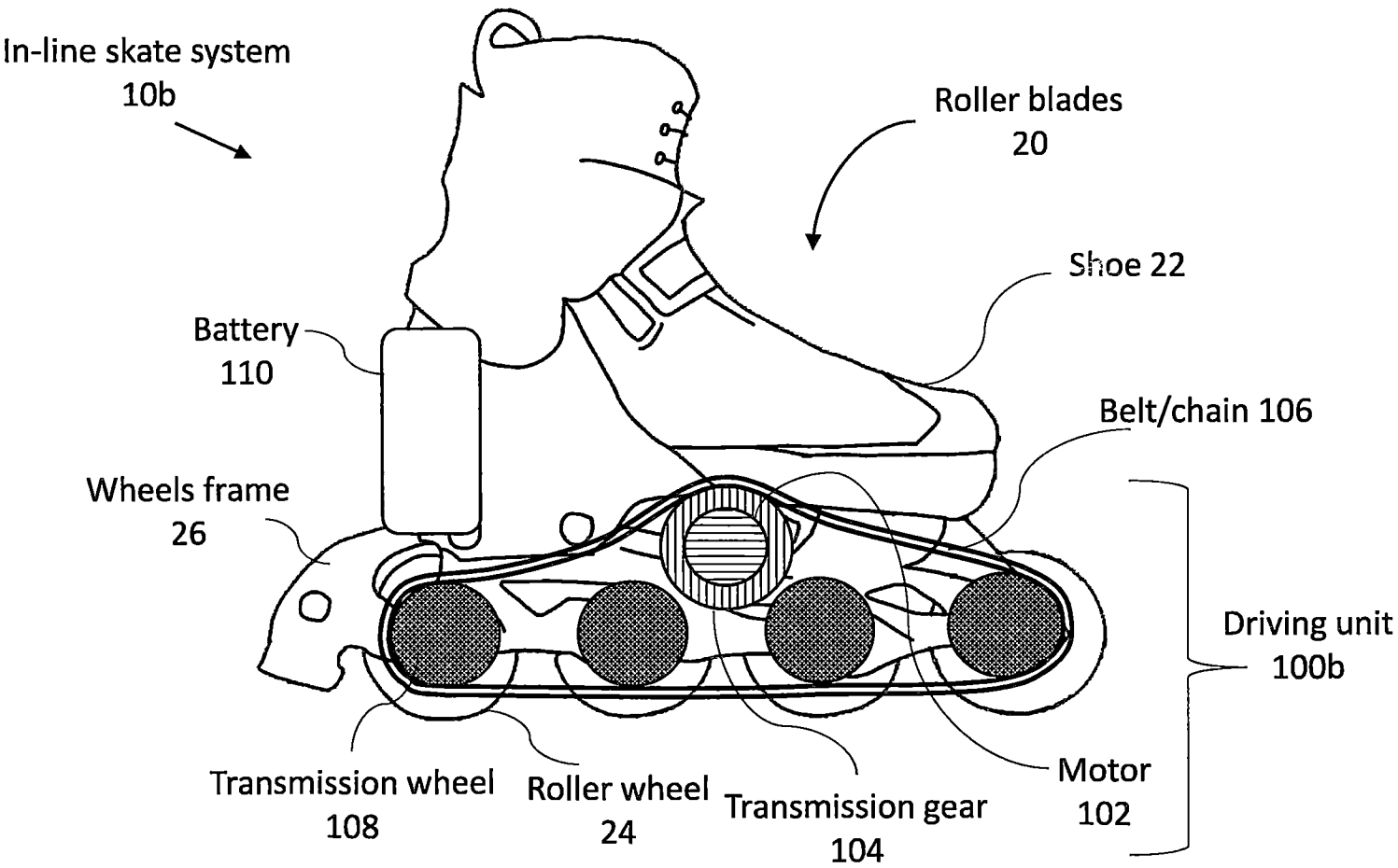
Figures 1C, 1D:
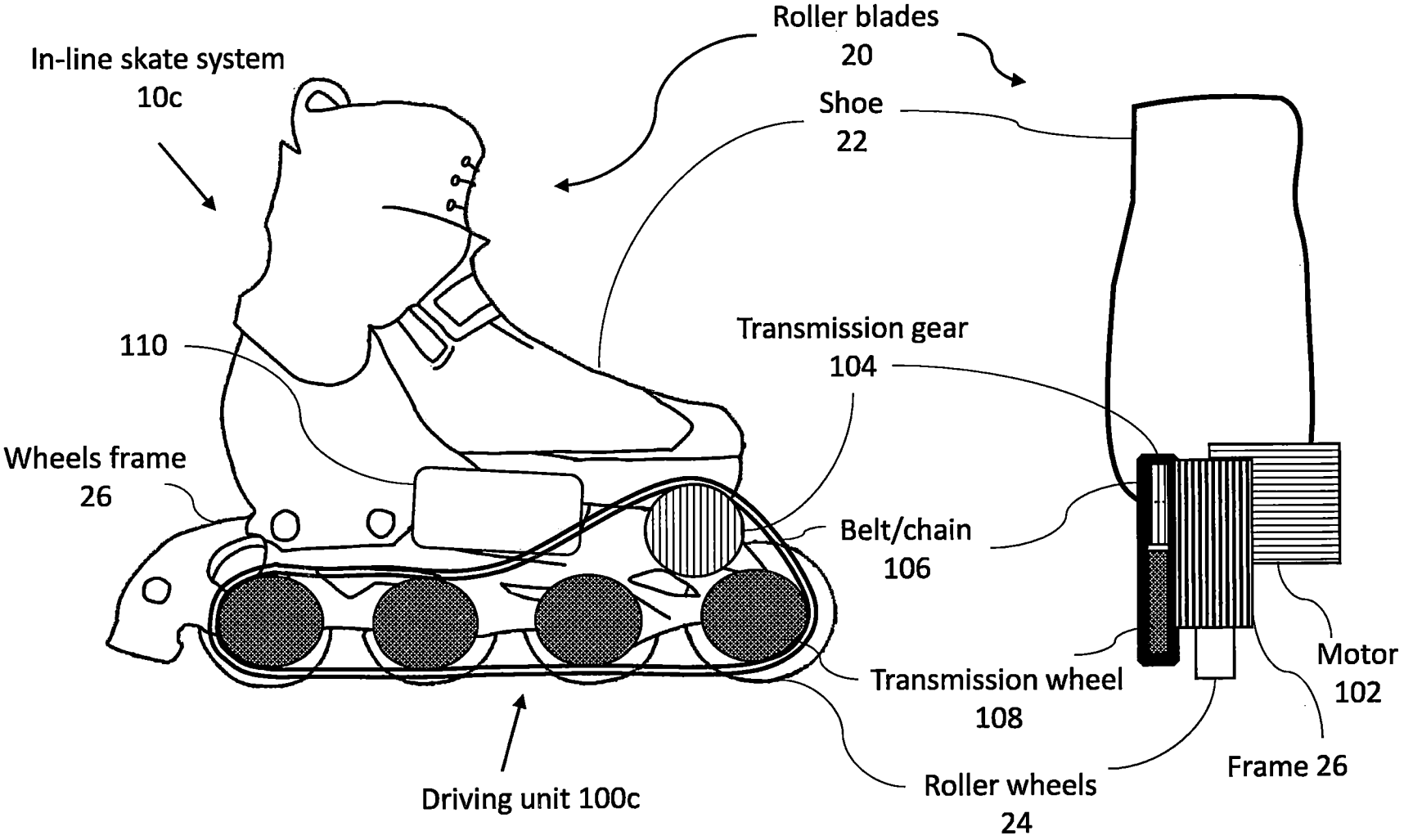
FIG. 1D is a schematic front or rear view illustration of an in-line skate system according to some embodiments of the current invention.

Referring now to the drawings, FIGS. 1A-1D illustrate side views of exemplified embodiments of driving units according to the current invention, coupled to an in-line skate system. As shown in FIGS. 1A-C, in-line skate systems 10*a*-10*c*, have a roller-blades set 20 that includes typical roller blades components, such as a shoe 22 and roller wheels 24.

According to some embodiments, in-line skate system 10*a*-10*c* includes a driving unit 100*a*-100*c* that comprises a motor 102 and a transmission gear 104 receiving rotation power (e.g. torque) from motor 102. In some embodiments, transmission gear 104 is connected to motor 102. In some embodiments, transmission gear 104 is connected to an output shaft of motor 102. In some embodiments, transmission gear 104 is connected to an output shaft of a gear module (e.g. speed reduction gear) connected to motor 102.

According to some embodiments, driving unit 100*a*-100*c* includes one or more of transmission wheels 108. According to some embodiments, unit has a driving belt 106 (e.g. transmission belt or transmission chain) connected to two or more roller wheel 24. In some embodiments, driving belt 106 is coupled to transmission wheel 104 (directly or indirectly using transmission means). As shown in the example embodiment in FIGS. 1A-1D, belt 106 is coupled to a side portion of wheels (i.e. not over the contact surface of the skate wheels 24). A potential advantage of having belt 106 at the side of wheels 24 is that is does not cover wheels 24, allowing skate system 100 to drive on surfaces using typical skate wheels having pre-define friction and other ride performance parameters.

According to some embodiments, motor 102 receives power from an electrical power source. As shown in FIGS. 1A-1C, power source 110 includes a battery. In some embodiments, power source 110 is coupled to shoe 22 (as shown in FIG. 1A). Other alternative embodiments may have power source 110 coupled to the wheels frame of roller blades 20 (as shown in FIG. 1C) or having power source 110 located remotely of roller blades 20 (e.g. held by an operator, wearable power source).

According to some embodiments, motor 110 and/or transmission gear 104 are coupled to a rear portion of roller blades 20 (FIG. 1A). In some embodiments, motor 110 and/or transmission gear 104 are coupled between the rear portion and the front portion of roller blades 20 (FIG. 1B). In some embodiments, motor 110 and/or transmission gear 104 are coupled at the front portion of roller blades 20 (FIG. 1C).

Turning to FIG. 1D, which is an example of a front view schematic illustration of an exemplified embodiment of driving units coupled to an in-line skate system according to the current invention. As shown in FIG. 1D motor 102 and transmission wheel 108 are coupled to roller blades 20 at opposing sides of wheels frame 26. A potential advantage of such fitting structure is reducing a lateral protrusion of the driving unit at a side of in-line skate system 10. Alternative embodiments may have motor 102 and transmission wheel 108 are coupled to roller blades 20 at the same side of wheels frame 26. A potential advantage of such fitting structure is reducing the distance between motor shaft and transmission gear 104. This may reduce the complexity of the gear system.

According to some embodiments, motor 110 and/or transmission gear 104 form a regeneration unit, which recharges the battery when roller wheels rotate in a speed higher than that provided by the driving unit. In some embodiments, regeneration unit recharges the battery when an external torque transferred to roller wheels 24 (e.g. by road surfaces) is higher than a driving torque transferred to roller wheels 24 by driving unit 100. This may be for example when driving the in-line skates in a downslope. In some embodiments, the regeneration unit receives the external torque as an input to motor 110. In some embodiments, the regeneration unit has a gearing mechanism that reverses the rotation of motor when in the recharging mode, when an external torque transferred to roller wheels 24 (e.g. by road surfaces) is higher than a driving torque transferred to roller wheels 24 by driving unit 100. In some embodiments, regeneration unit comprising a regeneration clutch for switching between torque driving mode, for transferring torque from motor 102 to wheel 24 and between torque regeneration mode for transferring torque from wheels 24 to motor 102.

According to some embodiments, driving unit 100 comprises a clutch like mechanism that allows to reduce the rotation of roller wheels 24 even when motor is operating. In some embodiments, clutch is assembled between motor 102 and transmission gear 104. In some embodiments, transmission gear 104 includes the clutch. In some embodiments, the clutch allows to free roller wheels 24 to rotate when motor 102 is not operating.

It is expected that during the life of a patent maturing from this application many relevant power sources, motor controllers will be developed; the scope of the terms power source and motor controllers is intended to include all such new technologies a priori.

The terms "comprises", "comprising", "includes", "including", "has", "having" and their conjugates mean "including but not limited to". The term "consisting of" means "including and limited to". The term "consisting essentially of" means that the composition, method or structure may include additional ingredients, steps and/or parts, but only if the additional ingredients, steps and/or parts do not materially alter the basic and novel characteristics of the claimed composition, method or structure.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

What is claimed is:

1. A driving unit for an in-line skate system, having roller wheels, the driving unit comprises:

a motor configured to generate driving power;

a transmission gear coupled to the motor;

a transmission belt interconnecting the transmission gear and the roller wheels to transfer the driving power to the roller wheel; and a regeneration unit, which recharges a battery in a regeneration mode initiated when the roller wheels rotate in a speed higher than the wheel rotation speed provided by the driving unit.

2. A driving unit according to claim 1, wherein the transmission gear is coupled to an output shaft of the motor.

3. A driving unit according to claim 1, comprising one or more transmission wheels, coupled to the roller wheel, and the transmission belt is fitted to the one or more transmission wheels.

4. A driving unit according to claim 3, wherein the motor and the transmission wheel are coupled to in-line skate system at opposing sides of the roller wheels.

5. A driving unit according to claim 1, wherein the transmission belt is coupled to a side portion of the roller wheels, keeping a driving surface of the roller wheels free to contact a driving surface.

6. A driving unit according to claim 1, comprising one or more gear wheels, transmitting rotation power between the motor and two or more wheel of the in-line skate system.

7. A driving unit according to claim 1, wherein the regeneration unit comprised the motor and the transmission gear, and the transmission gear is adapted to transfer an external torque applied on the roller wheel to the motor.

8. A driving unit according to claim 1, wherein the regeneration unit comprises a gearing mechanism adapted to reverse the rotation of the motor when in the regeneration mode.

9. A driving unit according to claim 1, wherein regeneration unit comprising a regeneration clutch for switching between torque driving mode, the regeneration mode for transferring torque from the roller wheels to the motor.

10. A driving unit according to claim 1, comprising a clutch mechanism that allows to reduce the rotation of the roller wheels when the motor is operating.

11. An in-line skate system, comprising one or more in-line skates and a driving unit according to claim 1.

12. An in-line skate system according to claim 11, comprising a power source electrically connected to the motor.

13. An in-line skate system according to claim 12, wherein the in-line skate system includes one or more shoes, and the power source is couplable to the one or more shoes.

14. An in-line skate system according to claim 12, wherein the power source is located remotely of the one or more in-line skates.

15. A driving unit according to claim 1, comprising a power source electrically connected to the motor.

16. A driving unit according to claim 15, wherein the in-line skate system includes one or more shoes, and the power source is couplable to the one or more shoes.

17. A driving unit according to claim 15, wherein the power source is located remotely of the in-line skate system.

18. A driving unit according to claim 1, wherein the motor is coupled to a rear portion of the in-line skate system.

19. A driving unit according to claim 1, wherein the motor is coupled between a rear portion and a front portion of the in-line skate system.

20. A driving unit according to claim 1, wherein the motor is coupled at the front portion of the in-line skate system.

* * * * *